US006070672A

United States Patent [19]

Gazda

[11] Patent Number: 6,070,672

[45] Date of Patent: Jun. 6, 2000

[54] APPARATUS AND METHOD FOR DOWNHOLE TOOL ACTUATION

[75] Inventor: Imre I. Gazda, Ft Worth, Tex.

[73] Assignee: Halliburton Energy Services, Inc., Dallas, Tex.

[21] Appl. No.: 09/009,707

[22] Filed: Jan. 20, 1998

[51] Int. Cl.[7] ..... E21B 34/14

[52] U.S. Cl. ..... 166/386; 166/317; 166/332.1

[58] Field of Search ..... 166/385, 386, 166/317, 332.1

[56] References Cited

U.S. PATENT DOCUMENTS

| | | | |
|---|---|---|---|
| 3,381,751 | 5/1968 | McLelland . | |
| 3,485,299 | 12/1969 | Young . | |
| 3,570,593 | 3/1971 | Hamilton | 166/64 |
| 3,661,207 | 5/1972 | Current et al. | 166/317 |
| 4,311,197 | 1/1982 | Hushbeck | 166/317 X |
| 4,429,747 | 2/1984 | Williamson, Jr. | 166/386 X |
| 4,452,313 | 6/1984 | McMahan | 166/317 X |
| 4,967,845 | 11/1990 | Shirk | 166/386 |
| 5,193,621 | 3/1993 | Manke et al. | 166/386 |
| 5,238,070 | 8/1993 | Schultz et al. | 166/386 |
| 5,482,119 | 1/1996 | Manke et al. | 166/386 X |
| 5,492,173 | 2/1996 | Kilgore et al. | 166/66.4 |

OTHER PUBLICATIONS

Otis Engineering Corporation New Employee Manual, "Wireline Services," © 1983, 1984 Otis Engineering Corporation A Halliburton Company, P. O. Box 819052, Dallas, Texas 75381–9052, pp. 21, 24, 25.

Otis Engineering Corporation, "General Sales Catalog," © 1985 Otis Engineering Corporation, P. O. Box 819052, Dallas, Texas 75281–9052, pp. 123, 294, 305.

*Primary Examiner*—George Suchfield

*Attorney, Agent, or Firm*—Paul I. Herman; John F. Booth

[57] ABSTRACT

In an oilfield wireline tool string, a self-contained downhole power unit is positioned at a designated working location and mechanical jars cut shear pins retaining an activating mandrel so as to displace a valve seat and open a mechanically actuated valve. This valve admits well pressure to a pressure-sensing switch in the downhole power unit to initiate its operation.

15 Claims, 3 Drawing Sheets

APPARATUS AND METHOD FOR DOWNHOLE TOOL ACTUATION

TECHNICAL FIELD

The present inventions relate to improvements in the actuation of downhole tools in subterranean wells and methods therefor.

BACKGROUND OF THE INVENTION

The use of subsurface well bore devices such as plugs, safety valves, packers, and the like is well-known in the oil field art. Such tools are generally lowered downhole by either a wireline or a working string and are typically configured with a fishing neck 318 to facilitate recovery at a later date. The tool is set at a chosen location and released, allowing the wireline or work string to be retrieved.

Conventional methods of setting and retrieving such tools are performed mechanically by a work string or wireline or by electrically actuated power units. Electrically actuated power units commonly utilize a conductor in the wireline to accomplish actuation by surface power, after the tool is properly positioned. Self-contained downhole power units, referred to as "DPUs," do not require electrical power from the surface and therefore, permit using a slickline rather than a wireline. The use of downhole power units and slicklines is desirable because of their relative speed and efficiency of use and because slickline equipment is more widely available than wireline equipment.

When a downhole power unit has been placed in the desired downhole working position, it may be actuated in several different ways. A timer, accelerometer, pressure sensor, or combination of such devices can be used to initiate actuation. A pressure actuated downhole power unit may be activated by a pressure sensor, preset to sense a given well bore pressure, corresponding to the depth of the planned downhole operation. Once the expected pressure is sensed, a timer delays actuation of the downhole power unit sufficiently to allow for its final positioning. Although this method is successful in most installations, sometimes downhole conditions defy prediction and a miscalculation causes the operation to fail.

Therefore, there is need of a method and apparatus to provide for more positive and timely actuation of a downhole power unit than is possible by currently practiced methods and available apparatus.

SUMMARY OF THE INVENTION

The present invention contemplates improved tool assemblies that achieve positive control of the pressure actuated downhole power unit by providing a surface controlled, mechanically operated valve to admit well bore pressure to the downhole power unit. Thus, with the present invention, the valve can be actuated from the surface to initiate a pressure and time sequence when the downhole power unit is at the proper location. The valve is mechanically operated and can be opened by a wireline or slickline operation. The valve is opened by shearing a pin with a mechanical jarring action, allowing well bore pressure to communicate with a pressure actuated switch in the downhole power unit. After a short time delay, the sequence for operation of the downhole power unit is initiated. Thus, activation of the downhole power unit is controlled mechanically, from the surface, in a positive and time efficient manner.

BRIEF DESCRIPTION OF THE DRAWINGS

The accompanying drawings are incorporated into and form a part of the specification to assist in explaining the present invention. The drawings illustrate preferred and alternative examples of how the invention can be made and used and are not to be construed as limiting the invention to only those examples, which are illustrated and described. The various advantages and features of the present invention will be apparent from a consideration of the drawings in which.

DETAILED DESCRIPTION OF THE DRAWINGS

Figure 1:
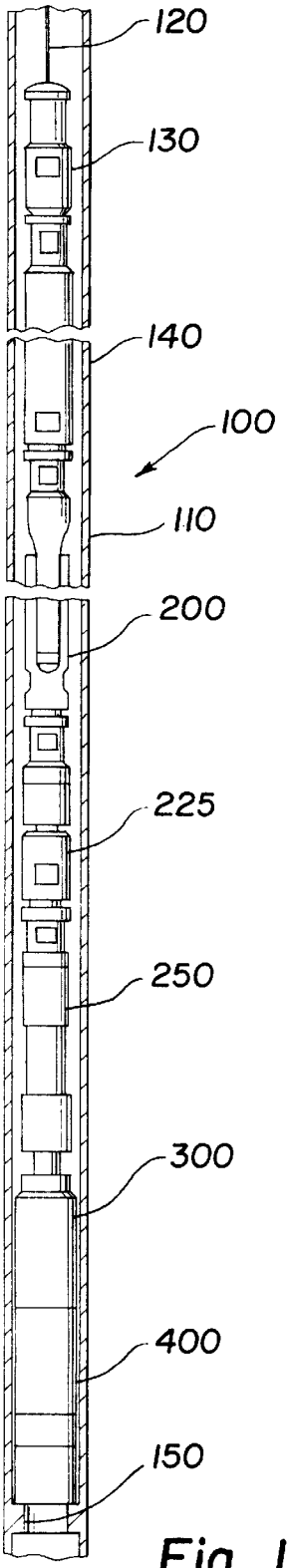
FIG. 1 is a longitudinal view of a wireline tool string assembly in a subterranean well casing including a preferred embodiment of the mechanical switch adapter, or valve, of the present invention.

The present invention is described in the following by referring to drawings of examples of how the invention can be made and used. In these drawings reference characters are used throughout the several views to indicate like or corresponding parts. In FIG. 1, one embodiment of a wireline tool string 100 for use in performing downhole well operations is shown.

Tool string 100 in well tubing 110 includes a mechanical pressure actuation adapter or valve assembly 300 connected to a conventional pressure actuated downhole power unit 400. Downhole power unit 400 includes a port for communicating well bore pressure to an internal pressure actuated switch (not shown). Typically, these pressure switches are adjusted for actuation by the pressure known to be present in the well bore at the depth of the selected location. As described hereinafter, valve assembly 300 of the present invention is connected to the downhole power unit to selectively block or open the port in downhole power unit 400 with respect to well bore pressure.

As illustrated, tool string 100 hangs downhole from slickline 120. A wire line socket 130 connects a length of pipe stem 140 to the slickline 120. Pipe stem 140 is connected to mechanical jars 200. A knuckle joint 225 connects mechanical jars 200 to a pulling tool 250. Valve assembly 300 is connected to the upper end of a conventional pressure actuated downhole power unit 400. Knuckle joint 225 provides angular freedom to allow downhole power unit 400 to centralize itself in the bore of well tubing 110, especially if a crooked or 'corkscrew' condition exists. downhole power unit 400 is a self-contained downhole tool or borehole device, self-powered by energy stored in a spring, gas pressure bottle, or a battery as typified by the disclosure of U.S. Pat. No. 5,492,173, the specification of which is incorporated herein by reference.

To use the present invention, tool string 100, including pressure actuated downhole power unit 400, is made up and lowered into well tubing 110. Tool string 100 is of the type that engages a positive stop, shown here as nipple or no-go configuration 150, at a predetermined downhole working location. As will be described hereinafter, when in the unactuated (closed) position, valve assembly 300 will isolate downhole power unit 400 from well bore pressure. When actuated (open), valve assembly 300 connects power unit 400 to well bore pressure. Valve assembly 300 is lowered down-hole in the closed position. When appropriate, valve assembly 300 is moved to the open position so as to begin the actuation process of downhole power unit 400. Valve assembly 300 is moved to the open condition by a downward jarring force applied to the string by mechanical jars 200. Jarring down is accomplished by running slickline 120 rapidly downhole so that the weight of pipe stem 140 impacts against the retracted length of mechanical jars 200. In this manner, down hole power unit 400 is activated only after valve assembly 300 opens to place the downhole power unit in fluid communication with the well bore.

Figure 2:
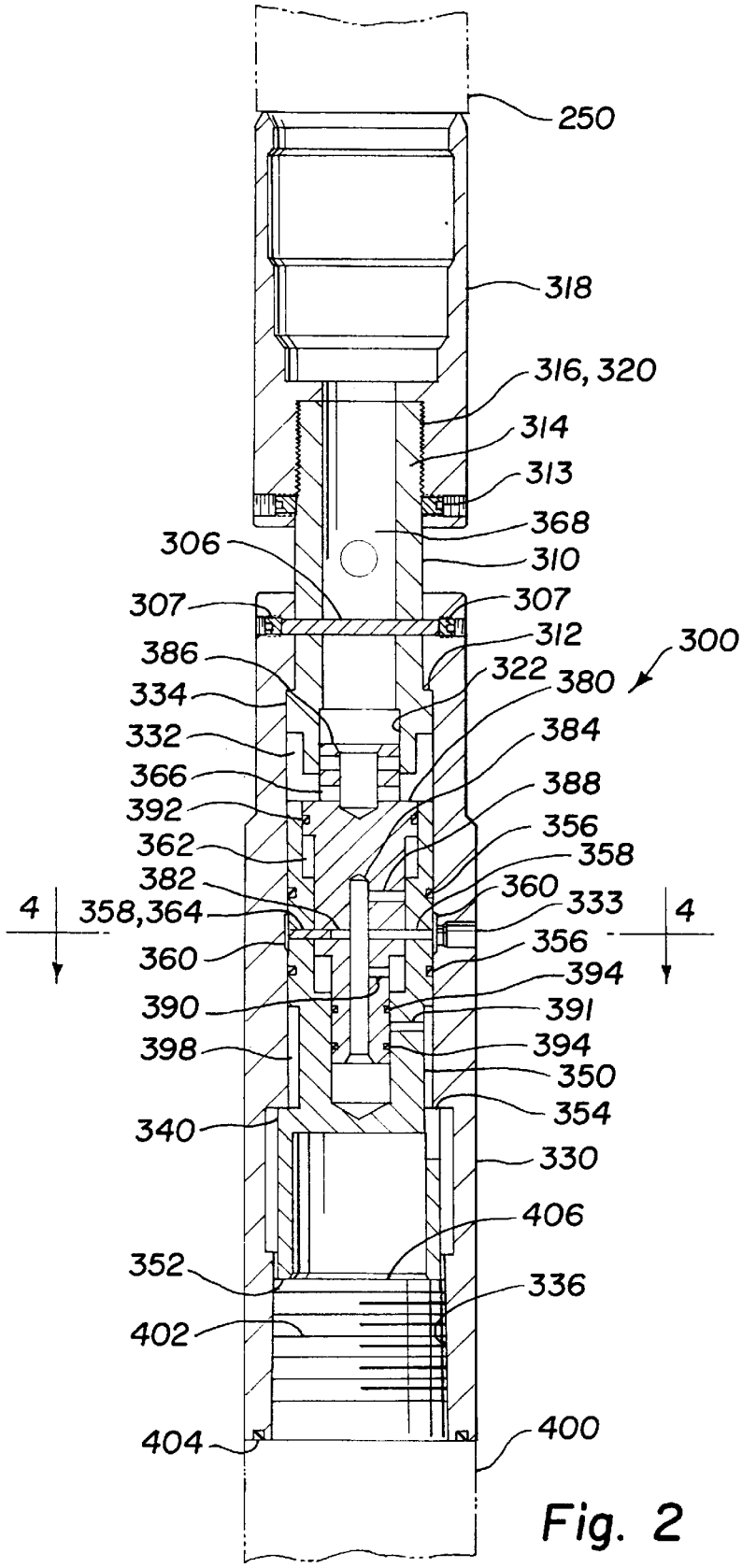
FIG. 2 is a longitudinal cross-section view of the valve of FIG. 1 as it appears prior to activation.

By referring to FIG. 2 details of valve assembly 300 will be explained. In FIG. 2, valve assembly 300 is shown closed, or as it appears prior to activation. Valve assembly 300 comprises activating plunger or mandrel 310 fitted for axial movement within housing 330. In the closed condition, mandrel 310 is temporarily fixed in position in housing 330 by a pin 306 designed to be sheared by downward jarring. Housing 330 has an axially extending, irregularly shaped chamber 332 extending therethrough and a radially extending passageway or port 333 extending through the wall of housing 330. A circumferential downward facing internal shoulder 334 is formed in the upper end of chamber 332. External shoulder 312 on activating mandrel 310 engages internal shoulder 334 to transfer the weight of the downhole portion of tool string 100 from mandrel 310 to housing 330.

Prior to actuation, activating mandrel 310 is retained in the illustrated axial position by shear pin 306. Shear pin 306 is mounted in radially extending bores in the walls of housing 330. Shear pin 306 extends through radial bores in mandrel 310 to hold the mandrel against shoulder 334. Set screws 307 close the outer ends of these bores and retain the shear pin 306 in place. When pin 306 is sheared, mandrel 310 moves downward in chamber 332 to the actuated position.

The uphole end 314 of activating mandrel 310 is connected to fishing neck 318 by mating threads 316 and 320, on mandrel 310 and fishing neck 318, respectively. Set screws 313 in fishing neck 318 engage grooves in activating mandrel 310 to lock the threaded connection against rotation.

Valve seat body 350 is mounted in chamber 332 of housing 330 at a point below activating mandrel 310. The lower end of chamber 332 includes internal threads 336. Internal threads 336 engage external threads 402 on the upper end of downhole power unit 400. The threaded connection between housing 330 and downhole power unit 400 is sealed by seal ring 404. The upper end 406 of unit 400 engages the lower end 352 of valve seat body 350 to hold it in position in housing 330. An upward facing, notched external shoulder 354 on valve seat body 350 is held against internal shoulder 340 in chamber 332 by upper end 406 of downhole power unit 400.

Axially spaced annular seals 356 are mounted in grooves in the exterior wall of valve seat body 350 to seal the annular space between valve seat body 350 and the wall of chamber 332. An unshown port is formed in the upper end 406 of power unit 400 and communicates with the internal pressure actuated switch of power unit 400. It is to be noted that this port places the pressure activation switch of down hole power unit 400 in fluid communication with the lower end of chamber 332. As illustrated, the two spaced seals 356 are axially positioned on either side of the port 333. Four circumferentially spaced, radial holes 358 are formed in the wall of valve seat body 350 and are axially positioned between the seals 356. Annular recess 360 is formed on the outside surface of the valve seat body 350 to provide a fluid connection between port 333 and bores 358.

Figure 4:
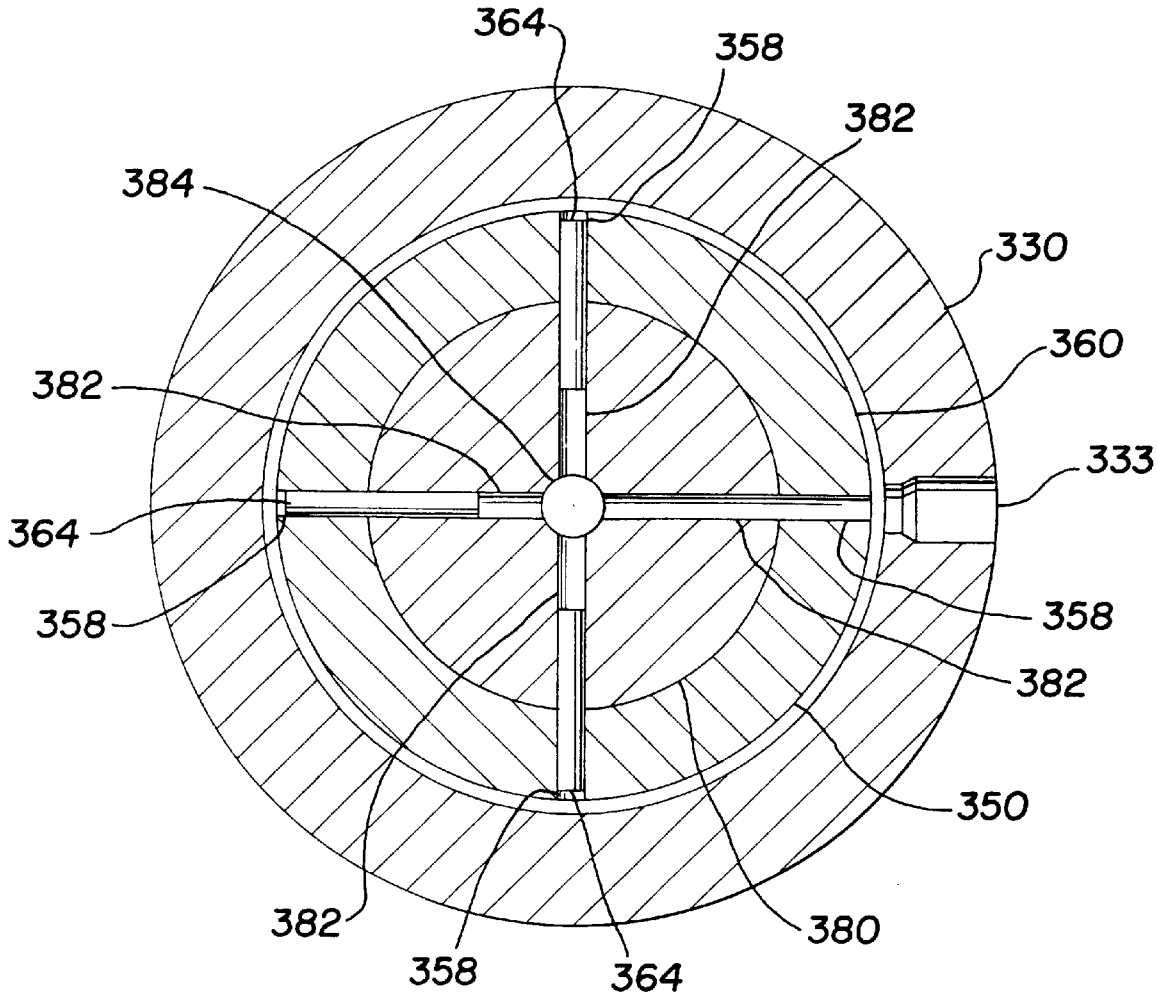
FIG. 4 is a transverse cross-sectional view taken at plane 4—4 of FIG. 2.

Valve 380 is mounted for axial movement in an axially extending, irregularly shaped chamber 362, formed in valve seal body 350. Valve 380 is temporarily held in position in chamber 362 by one or more shear pins 364. Four radial shear pin holes 382 in the valve 380 align with holes 358 in valve seat body 350. Three shear pins 364 (ref. FIG. 4) are mounted in three sets of the aligned holes 358 and 382 in valve 380 and valve seat body 350 respectively, to prevent movement of valve 380 in valve seat body 350. The fourth set of aligned holes 358 and 382 is left open to serve as a port, connecting port 333 with axial passageway 384 in valve 380. During opening or activation of the valve assembly 300, pins 364 are sheared, freeing valve body 350 to move axially downward in chamber 362. Shearing is accomplished by downward impact of the lower end of mandrel 310 on the upper end of valve 380 during the jarring operation. As illustrated, the male portion 386, at the upper end of valve 380, telescopes into female portion 322 formed on the lower end of mandrel 310.

There are two additional radial ports 388 and 390 in the wall or valve 380, connecting to axial passageway 384. Port 388 is positioned axially above shear pin holes 358, while port 390 is axially below these holes. Port 333 is connected through open aligned holes 358 and 382 to axial passageway 384 in valve 380. In the position illustrated in FIG. 2, annular seal 392 seals the upper end of the annulus formed between chamber 362 and valve 380. It is also seen that annular seals 356 seal chamber 332 with respect to external port 333 and that seals 394 isolate axial passageway 384 from valve seat body port 391. Thus, external port 333, which could otherwise communicate with the upper end of downhole power unit 400 through annulus 398 and notched shoulder 354, is isolated from downhole power unit 400.

Figure 3:
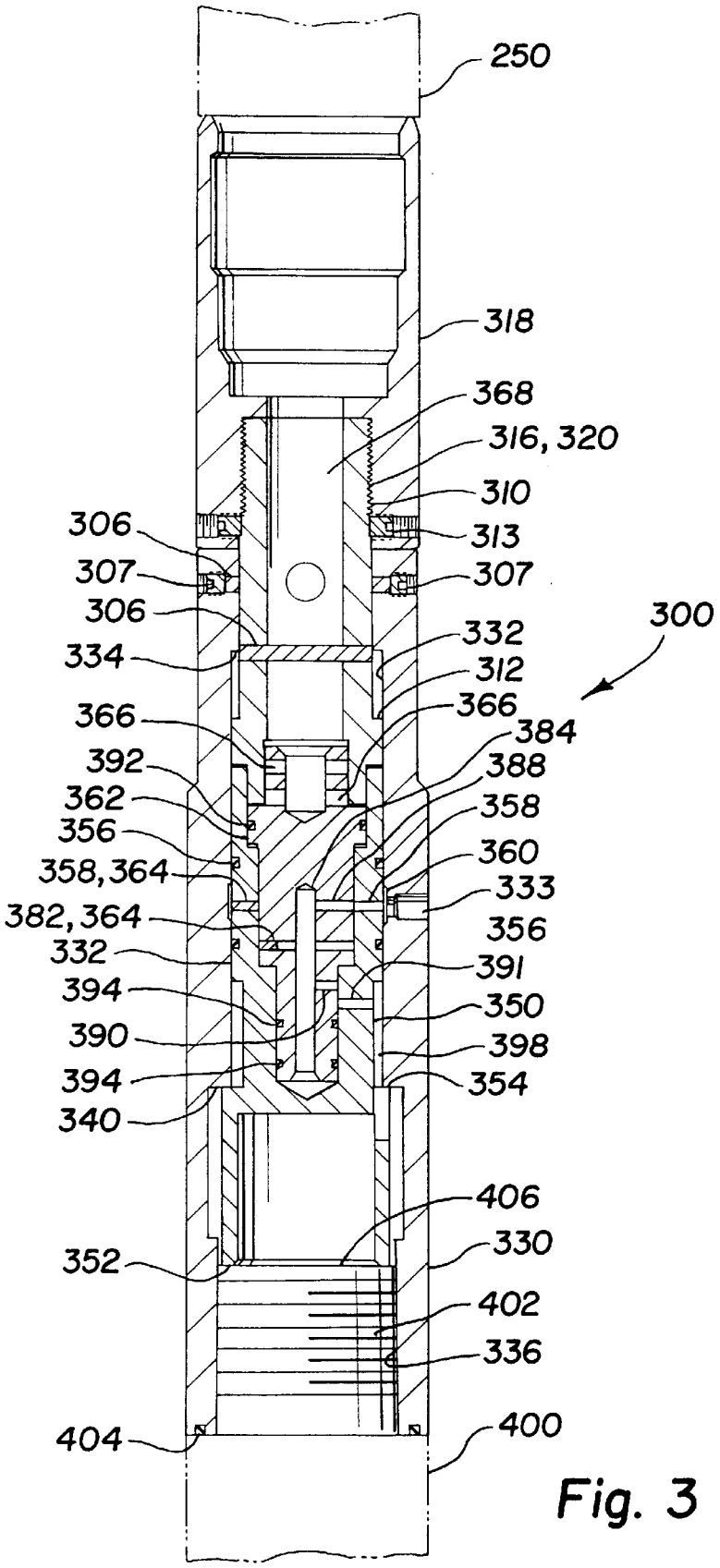
FIG. 3 is a longitudinal cross-section view of the valve of FIG. 1 as it appears after activation.

In FIG. 3, valve assembly 300, of the FIG. 1 tool string 100 is seen as it appears in the activated, open position. Here, activating mandrel 310 has been driven downward by fishing neck 318, under the impact of mechanical jars 200, so as to cut shear pin 306. As activating mandrel 310 moves toward valve 380, any trapped fluid within chamber 332 is displaced through radial relief ports 366 and out through axial passage 368. This maintains the intensity of impact against valve 380 for cutting shear pins 364 and shifting valve 380 to the position shown. In this position, well bore pressure passes through external port 333 to the downhole power unit 400. The flow path is as follows, well pressure enters through port 333, to pen shear pin hole 358 and aligned hole 382, through axial passageway 384, through port 390 to port 391 and annulus 398, through notched external shoulder 354 and thence, to downhole power unit 400. Upon admission of well bore pressure into downhole power unit 400, the actuation sequence of downhole power unit 400 is initiated as is discussed in previously referenced U.S. Pat. No. 5,492,173, except without a time delay or, with the time delay set at a minimum value.

FIG. 4 is a view taken along plane 4—4 of FIG. 2, showing the cross-section of housing 330, valve seat body 350 and valve 380. The four shear pin holes 358 in valve seat body 350 are seen to be in alignment with the four holes 382 in valve 380. Three shear pins 364 extend through three of the four shear pin holes 358 and aligned holes 382. Also seen here is the flow path through annular recess 360 and aligned open holes 358 and 382 into axial passageway 384.

The embodiments shown and described above are only exemplary. Many details are often found in the art such as: wireline running and retrieving tools, packers, and the like. Therefore many such details are neither shown nor described. It is not claimed that all of the details, parts, elements, or steps described and shown were invented herein. Even though numerous characteristics and advantages of the present inventions have been described in the drawings and accompanying text, the description is illustrative only, and changes may be made in the detail, especially in matters of shape, size, and arrangement of the parts thereof within the principles of the inventions to the full extent indicated by the broad general meaning of the terms used the attached claims.

The restrictive description and drawings of the specific examples above do not point out what an infringement of this of this patent would be, but are to provide at least one explanation of how to make and use the inventions. The limits of the inventions and the bounds of the patent protection are measured by and defined in the following claims:

What is claimed:

1. Apparatus for activating a well downhole power unit comprising:

an external pressure source;

a pressure responsive actuating switch mounted in the interior of the downhole power unit;

a passageway to the actuating switch, connecting the external pressure source thereto; and a mechanically operated valve interposed between the actuating switch and the external pressure source, the valve being remotely operable between a closed position, sealing the actuating switch from the external pressure source, and an open position in which the external pressure source communicates with the actuating switch.

2. Apparatus for activating a downhole power unit according to claim 1 and further comprising mechanical jars for remotely operating the valve.

3. Apparatus for activating a downhole power unit according to claim 1 wherein the valve further comprises:

a valve seat body;

a valve fitted for axial movement within the valve seat body so as to provide a closed valve position and an open valve position.

4. Apparatus for activating a downhole power unit according to claim 3 and further comprising at least one shear pin holding the valve in the closed position.

5. Apparatus for activating a downhole power unit according to claim 4 and further comprising mechanical jars for cutting the at least one shear pin so as to remotely operate the valve.

6. Apparatus for activating a well downhole power unit comprising:

a downhole power unit assembly having a housing with a down hole end and an uphole end, the housing having an internally mounted pressure actuated switch and a port in communication with the pressure actuated switch;

a valve mounted in the housing for movement between a position blocking flow through the port and an open position passing flow through the port to the downhole power unit;

an activating plunger in the housing mounted for sliding movement between a first position to a second valve contacting position wherein the valve is displaced to the open position;

at least one shear pin holding the activating plunger in the first position; and shearing mechanism selectively operable to cut the shearpin so that the activating plunger can move to displace the valve to the open position.

7. Apparatus for activating a downhole power unit according to claim 6 wherein the cutting mechanism is operable by mechanical jars.

8. Apparatus for controlling activation of a well downhole power unit comprising:

a downhole power unit having a down hole end and an uphole end and an internally mounted pressure actuated activation switch;

a housing having an internal chamber with a port communicating between the chamber and the extension of the housing, the housing chamber being connected to said downhole power unit uphole end;

an activating plunger fitted in the housing chamber for movement between a first, passive position to a second, activating position;

a retainer holding the activating plunger in the first position; and a valve mounted for movement within the housing chamber, the valve sealing against flow through the port to the activation switch when in a first position and passing flow to the activation switch when in a second position the valve being operably associated with the plunger whereby movement of the plunger will cause the valve to mate to the second position.

9. Apparatus for activating a downhole power unit according to claim 8 additionally comprising means to move the plunger.

10. Apparatus for activating a downhole power unit according to claim 8 wherein the retainer comprises at least one shear pin.

11. Apparatus for activating a downhole power unit according to claim 9 wherein the means for moving the plunger comprises mechanical jars.

12. A method for starting operation of a self-powered well downhole tool in a cased well comprising the steps of:

providing a remotely controlled, mechanically operated valve for selectively admitting well bore pressure to a pressure actuated switch for starting operation of the self-powered downhole tool;

running the self-powered downhole tool to a positive stop at the desired working location; and operating the valve to admit well bore pressure to the pressure actuated switch to start operation of the self-powered downhole tool.

13. A method for starting operation of a self-powered downhole tool in a tool string according to claim 12 wherein the positive stop is provided by engaging the well casing.

14. A method for starting operation of a self-powered downhole tool in a tool string according to claim 12 wherein the positive stop is provided by engaging a no-go configuration in the well casing.

15. A method for starting operation of a self-powered downhole tool in a tool string according to claim 12 wherein the positive stop is provided by engaging a pipe nipple in the well casing.

* * * * *